US009500001B2

(12) United States Patent
Sherstad

(10) Patent No.: US 9,500,001 B2
(45) Date of Patent: Nov. 22, 2016

(54) INSTALLABLE TOP ACCENT PANELS FOR A BARRIER SYSTEM

(71) Applicant: Fortress Iron, LP, Richardson, TX (US)

(72) Inventor: Matthew Carlyle Sherstad, Dallas, TX (US)

(73) Assignee: FORTRESS IRON, LP, Richardson, TX (US)

( * ) Notice: Subject to any disclaimer, the term of this patent is extended or adjusted under 35 U.S.C. 154(b) by 0 days.

(21) Appl. No.: 14/445,996

(22) Filed: Jul. 29, 2014

(65) Prior Publication Data

US 2014/0332741 A1 Nov. 13, 2014

Related U.S. Application Data

(63) Continuation of application No. 12/324,105, filed on Nov. 26, 2008, now abandoned.

(60) Provisional application No. 60/992,560, filed on Dec. 5, 2007.

(51) Int. Cl.

| | |
|---|---|
| ***E04H 17/16*** | (2006.01) |
| ***E04H 17/24*** | (2006.01) |
| *E04H 17/00* | (2006.01) |

(52) U.S. Cl.

CPC ..... *E04H 17/165* (2013.01); *E04H 17/00* (2013.01); *E04H 17/16* (2013.01); *E04H 17/24* (2013.01); *E04H 17/003* (2013.01)

(58) Field of Classification Search

CPC ..... E04H 17/16; E04H 17/24; E04H 17/14; E04H 17/1426; E04H 17/165; E04H 17/166; E04H 17/1417; E04H 17/1439; E04H 17/003; E04H 17/1421; E04F 11/1836; E04F 11/1817

USPC ..... 256/24, 11, 21, 22, 19, 12, 17, 65.14, 256/65.15, 65.16, 65.01; 119/52.3

See application file for complete search history.

(56) References Cited

U.S. PATENT DOCUMENTS

| | | | | |
|---|---|---|---|---|
| 2,717,751 | A * | 9/1955 | Kusiv | H01Q 1/1221 248/216.1 |
| 3,258,251 | A * | 6/1966 | Culter | E04F 11/181 256/22 |
| 3,315,926 | A * | 4/1967 | Trenda | E04H 12/32 116/173 |
| 3,454,262 | A | 7/1969 | Romano | |
| 3,652,060 | A | 3/1972 | Glover | |
| 3,918,686 | A * | 11/1975 | Knott | E04F 11/181 256/21 |
| 3,943,524 | A * | 3/1976 | Sample | H01Q 1/1221 248/539 |
| 4,143,857 | A * | 3/1979 | Weiner | E04H 17/003 16/312 |
| 4,214,734 | A | 7/1980 | Stafford | |
| 4,825,590 | A * | 5/1989 | Cullinane | A47G 7/044 248/229.16 |
| 5,664,367 | A * | 9/1997 | Huang | A47G 7/044 248/311.2 |
| 6,398,193 | B1 | 6/2002 | DeSouza | |
| 6,637,728 | B2 | 10/2003 | Pettit et al. | |
| 6,742,757 | B2 * | 6/2004 | Fox | F16M 13/02 248/535 |
| 6,824,123 | B2 | 11/2004 | Larsen et al. | |
| 6,863,265 | B2 * | 3/2005 | Perry | E04H 17/1443 256/21 |
| 7,032,890 | B2 | 4/2006 | Svalbe | |

(Continued)

*Primary Examiner* — Daniel P Stodola
*Assistant Examiner* — Matthew R McMahon
(74) *Attorney, Agent, or Firm* — Gardere Wynne Swell, LLP; Andre M. Szuwalski; John Jacob May

(57) ABSTRACT

An accent top panel is selectably installed on a base panel. The installation is made using one of a number of techniques, including, press-fit, clamp fit and clip fit. The base panel can be one of a fence panel, railing panel or gate.

15 Claims, 7 Drawing Sheets

(56) References Cited

U.S. PATENT DOCUMENTS

| | | | | |
|---|---|---|---|---|
| 7,341,242 | B2 | 3/2008 | Bertato | |
| 7,384,025 | B2 | 6/2008 | Lo | |
| 7,744,065 | B2 | 6/2010 | Terrels et al. | |
| 2002/0070377 | A1 | 6/2002 | Erwin | |
| 2006/0255325 | A1 | 11/2006 | Lo et al. | |
| 2007/0158630 | A1* | 7/2007 | Lo | F16B 7/0473 256/59 |
| 2007/0267617 | A1 | 11/2007 | Dombroski | |
| 2007/0278468 | A1 | 12/2007 | Zacarias et al. | |
| 2008/0121857 | A1 | 5/2008 | Lo | |
| 2008/0217598 | A1 | 9/2008 | Dombroski | |
| 2009/0050862 | A1* | 2/2009 | Cruce | E04H 17/00 256/8 |
| 2009/0140227 | A1 | 6/2009 | Cantatore | |
| 2009/0166599 | A1 | 7/2009 | Lo | |
| 2011/0073823 | A1 | 3/2011 | Mitrovic | |

* cited by examiner

INSTALLABLE TOP ACCENT PANELS FOR A BARRIER SYSTEM

CROSS REFERENCE TO RELATED APPLICATION

This application is a continuation of U.S. application for patent Ser. No. 12/324,105, filed Nov. 26, 2008, which claims the benefit of U.S. Provisional Application for Patent No. 60/992,560 of the same title filed on Dec. 5, 2007, the disclosures of which are incorporated by reference.

FIELD OF THE INVENTION

The present invention relates generally to barriers to pedestrians or vehicles, and more particularly to fences and fence components, as well as railings and railing components, which have a selectably installable top accent panel.

SUMMARY

The present invention comprises a barrier formed from a set of elongate rails and a set of vertical upright members. An accent top panel is selectably installable on a top-most positioned one of the elongate rails of the barrier. The accent top panel includes a base rail having a flat web and a pair of opposed side walls which extend from the web to define a rail channel. The decorative accent features of the top panel are mounted to and above the base rail. The base rail is sized and shaped to fit over the top one of the elongate rails such that the elongate rail is received by the rail channel.

In one implementation, the base rail is designed with dimensions and manufacturing tolerances such that the opposed side walls snugly contact the opposed sides of the top elongate rail in a press-fit manner.

In another implementation, the base rail is designed with a geometry such that the opposed side walls are angled slightly inwardly to form a biasing clamp against the opposed sides of the top elongate rail.

In another implementation, the base rail is designed such that an inner surface of the opposed side walls includes an inwardly projecting bead (or detent) which either engages a bottom edge of the opposed sides of the top elongate rail or snugly contacts the opposed sides of the top elongate rail in a press-fit manner.

An embodiment of the present invention comprises an accent top panel (alone) having any of the configurations discussed above.

DETAILED DESCRIPTION OF THE DRAWINGS

Accent top panels are decorative additions selectably attached to the top of a fence panel, railing panel, or a gate.

The accent top panels are used to convert a plain fence or railing installation into an installation capable of matching or establishing a particular architectural or ornamental motif. The top panels also provide added height to the fence panel, railing panel, or a gate which may be needed in order to meet certain building codes or provide an added level of security. Reference is made to FIGS. 1-6 which illustrate in an exemplary manner certain architectural or ornamental motifs with can be used for accent top panels. The architectural or ornamental motif features of the accent top panels are not a part of the present invention. Rather, it will be understood that any desired architectural or ornamental motif can be selected for use with the accent top panels of the present invention. A structural implementation of the accent top panels of FIGS. 1-6 includes a bottom rail 1, a plurality of upright members 2*a*-2*d* (of different shape as shown) extending upwardly from the bottom rail, and an upper rail 3. The bottom rail 1, upright members 2*a*-2*d* and upper rail 3 can, as shown in FIGS. 1-6, be designed to present a number of different architectural or ornamental motifs. For ease of description and illustration, the architectural or ornamental motif illustrated in FIG. 1 will be used, without any limitation, in connection with the description of a unique way of installing and attaching the accent top panel to a fence panel, railing panel or a gate.

Figure 1:
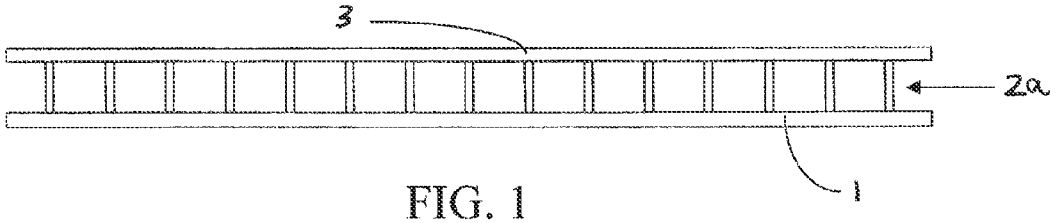
FIGS. 1-6 illustrate in an exemplary manner certain architectural or ornamental motifs with can be used for accent top panels.
Figure 2:
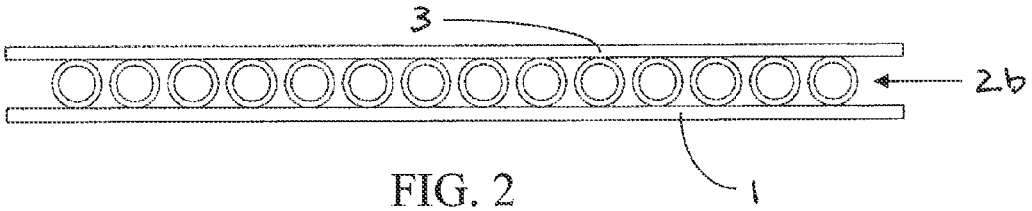
Figure 3:
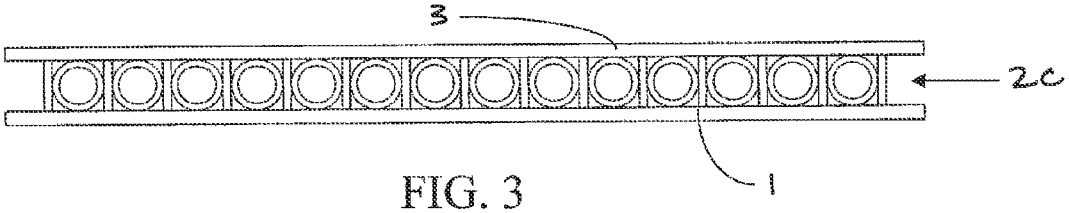
Figure 4:
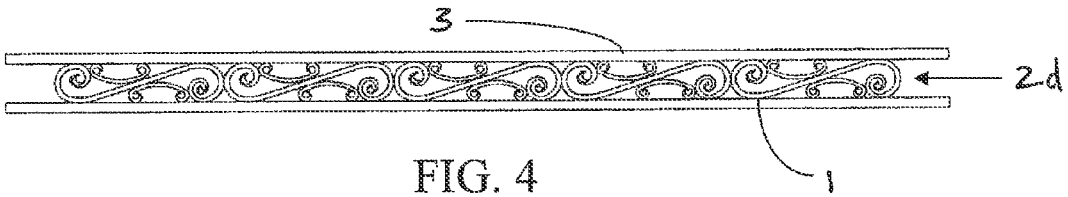
Figure 5:
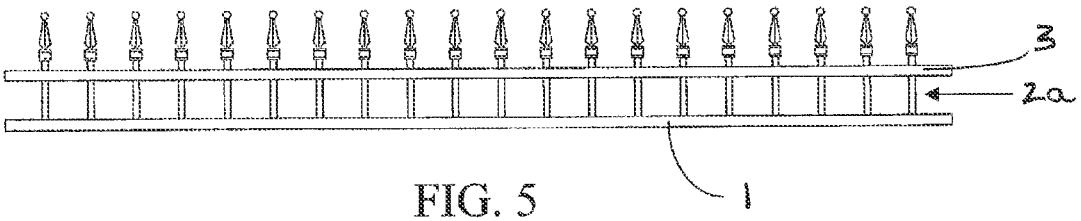
Figure 6:
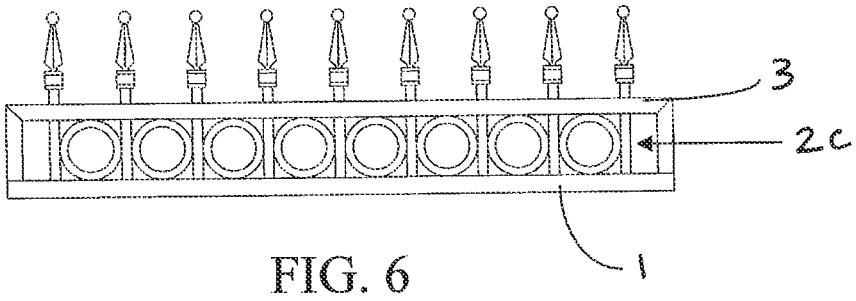
Figure 7:
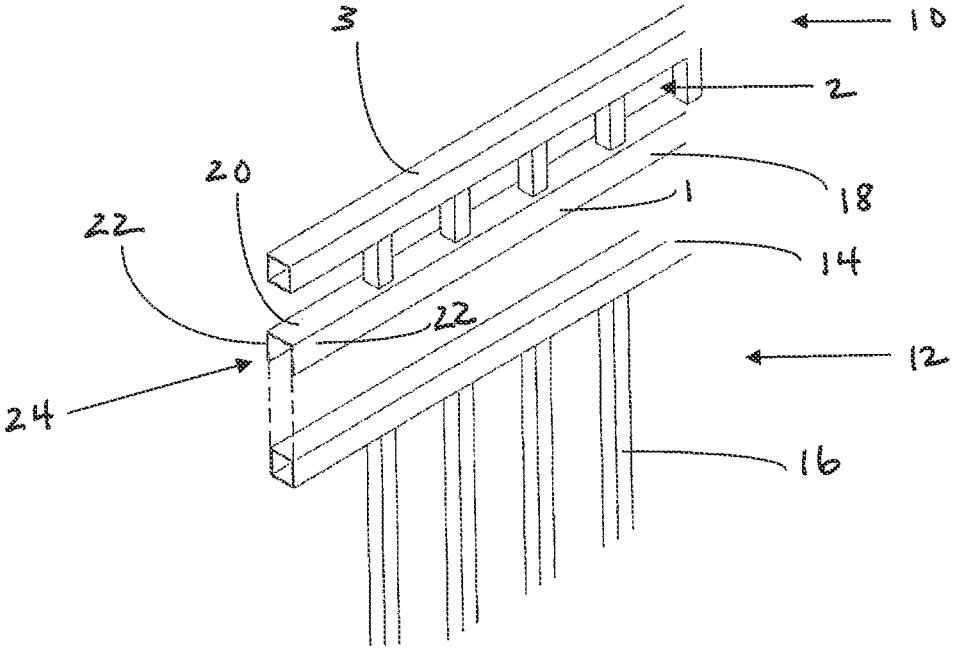
FIGS. 7-8 generally illustrate how an accent top panel having a selected architectural or ornamental motif is installed onto a fence panel, railing panel or a gate.
Figure 8:
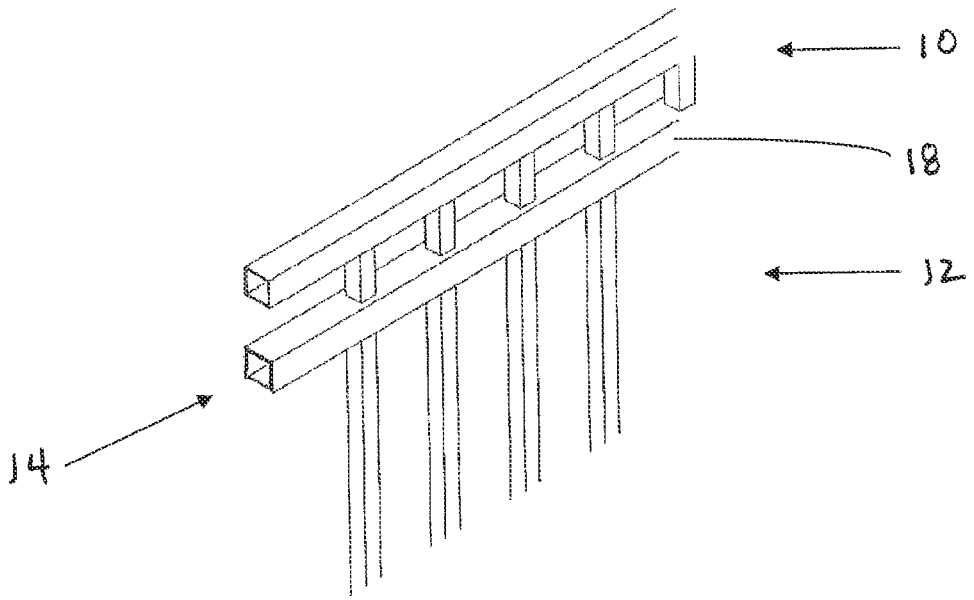

Reference is now made to FIGS. 7 and 8 will generally illustrate how an accent top panel 10 having a selected architectural or ornamental motif is installed onto a fence panel, railing panel or a gate (referred to herein as a base panel 12). The base panel 12 includes an elongate top rail 14 and at least one vertical upright member 16. The accent top panel 10 includes a base rail 18 having a flat web 20 and a pair of opposed side walls 22 which extend downwardly from the web to define a rail channel 24. The rail channel has a geometry (size and shape) which would allow for the elongate top rail of the base panel to be received therein (see, FIG. 8). Since the base panel 12 is subject to movement, and the accent top panel 10 is a separate piece, it is important to secure the base rail 18 of the accent top panel to the elongate top rail 14 of the base panel. It is known in the art to use welding, gluing or screws in order to make this secure attachment. These mechanisms are not always successful in satisfactorily securing the accent top panel to the base panel. Additionally, several known securing mechanisms suffer from the drawback that the securing means can damage, deform or deface the accent top panel (especially the base rail thereof). Additionally, some of these securing mechanisms can allow for rusting to occur.

Figure 9:
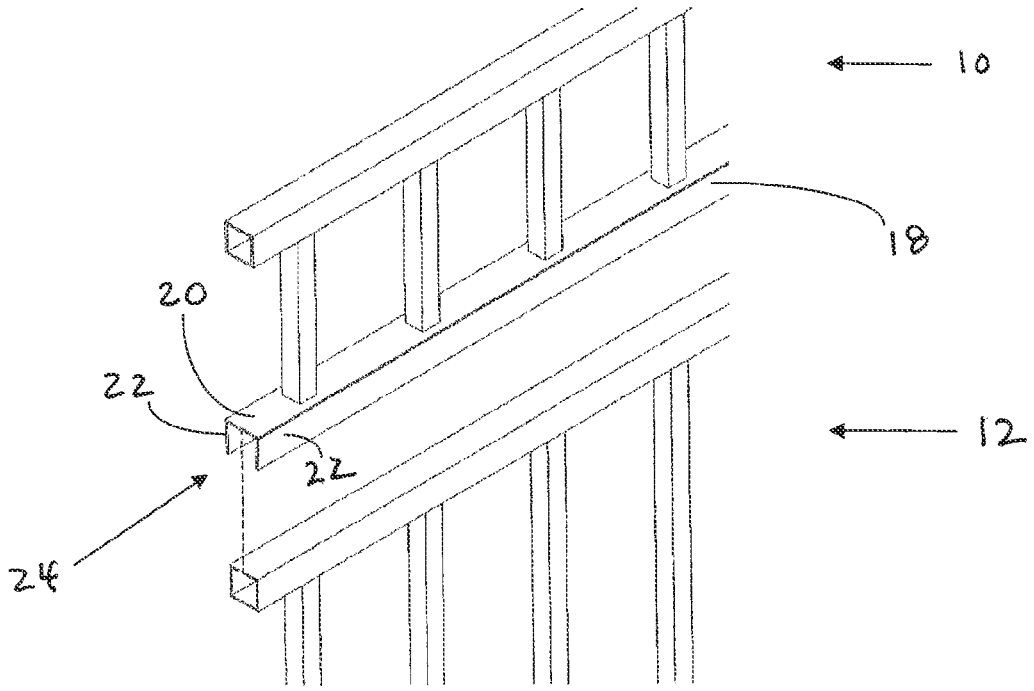
FIGS. 9-10 illustrate press-fit installation.
Figure 10:
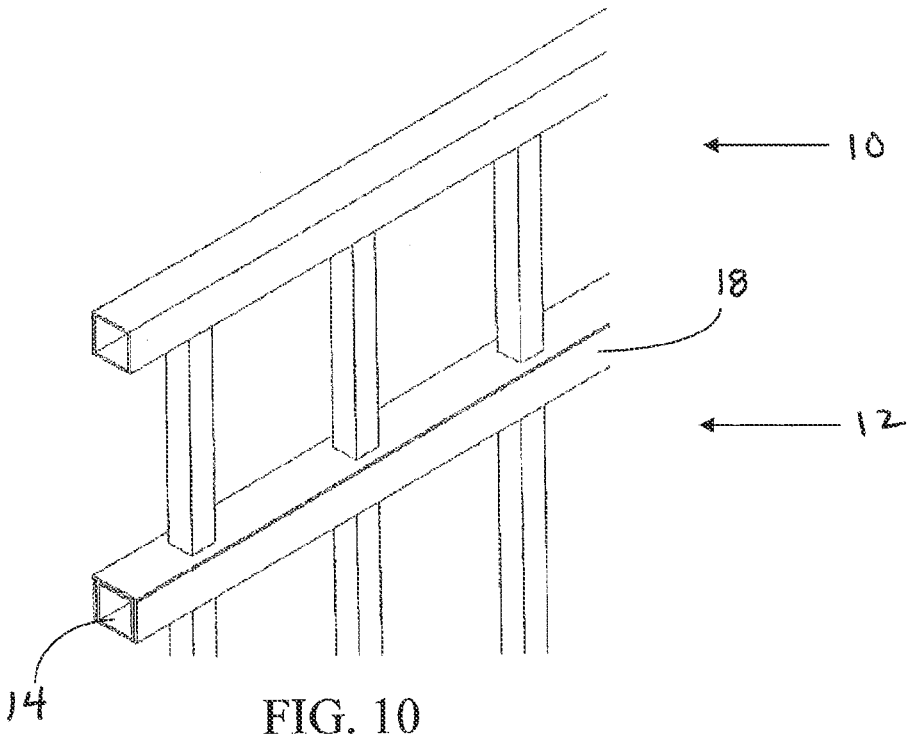

Reference is now made to FIGS. 9 and 10 wherein there is shown a first implementation for an accent top panel 10 including improved means for securing the accent top panel to a base panel 12. Again, the accent top panel 10 includes a base rail 18 having a flat web 20 and a pair of opposed side walls 22 which extend from the web to define a rail channel 24. The decorative accent features (architectural or ornamental motif features) of the top panel are mounted to and above the base rail. The base rail is sized and shaped to fit over the top one of the elongate rails 14 such that the elongate rail is received by the rail channel. In particular, FIGS. 9 and 10 illustrate that the base rail is designed with dimensions and manufacturing tolerances such that the opposed side walls snugly contact the opposed sides of the top elongate rail in a press-fit manner. Preferably, the depth of the pair of opposed side walls is chosen such that the elongate top rail is received fully within the rail channel. In other words, from a horizontal point of view, after the accent top panel has been installed, one would not be able to see the sides of the elongate top rail. This is an aesthetic feature which preserves the illusion that the accent top panel and base panel are a single panel. It is also a structural feature in that it helps to retain the accent top panel on base panel. The structure further provides added height to the fence panel, railing panel, or a gate which may be needed in order to meet certain building codes or satisfy an added level of security.

Figure 11:
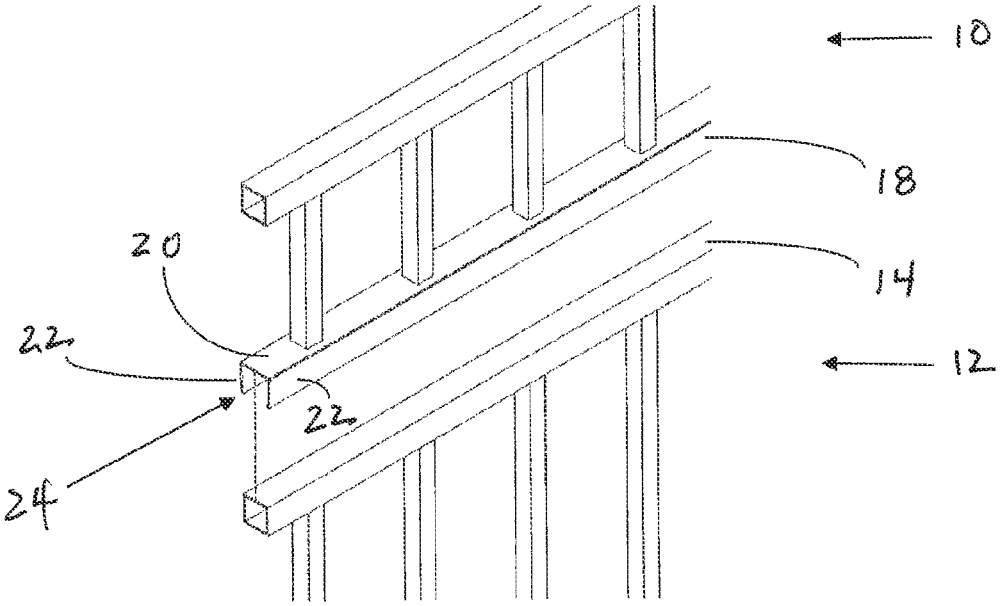
FIGS. 11-12 illustrate biasing clamp installation.
Figure 12:
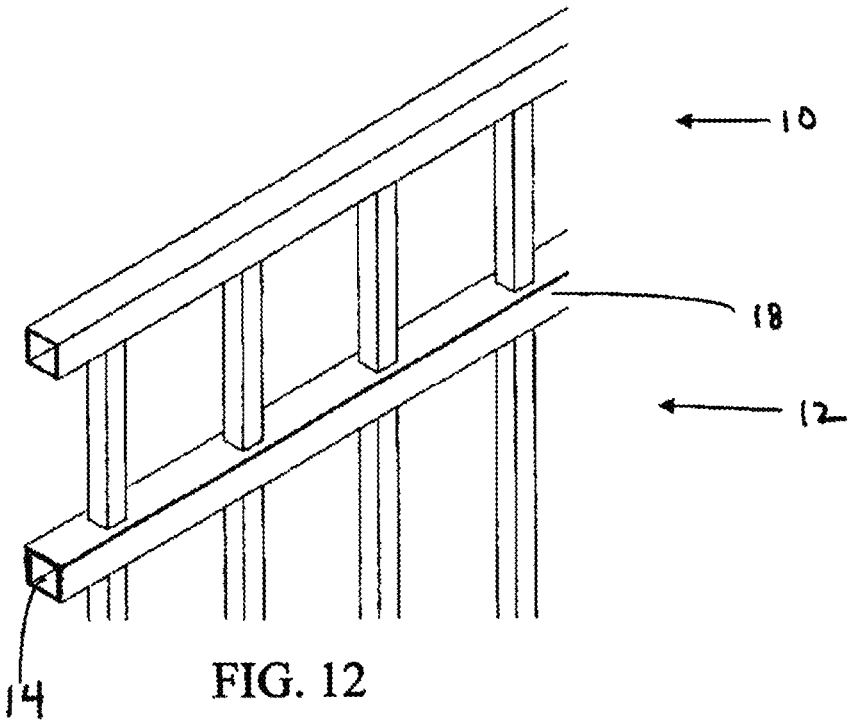

Reference is now made to FIGS. 11 and 12 wherein there is shown a second implementation for an accent top panel 10 including improved means for securing the accent top panel to a base panel 12. Again, the accent top panel includes a base rail 18 having a flat web 20 and a pair of opposed side walls 22 which extend from the web to define a rail channel 24. The decorative accent features (architectural or ornamental motif features) of the top panel are mounted to and above the base rail. The base rail is sized and shaped to fit over the top one of the elongate rails 14 such that the elongate rail is received by the rail channel. In particular, FIGS. 11 and 12 illustrate that the base rail is designed with a geometry such that the opposed side walls are angled slightly inwardly to form a biasing clamp against the opposed sides of the top elongate rail. The inward angular degree of the opposed side walls of the base rail need only be a few degrees (taken with reference to vertical) in order to achieve the desired clamping function. In this implementation, the dimensions and manufacturing tolerances with respect to the opposed side walls need not be so precise as to snugly contact the opposed sides of the top elongate rail since the inward angular bias and clamp structure will serve to secure the accent top panel. Preferably, the depth of the pair of opposed side walls is chosen such that the elongate top rail is received fully within the rail channel. In other words, from a horizontal point of view, after the accent top panel has been installed, one would not be able to see the sides of the elongate top rail. This is an aesthetic feature which preserves the illusion that the accent top panel and base panel are a single panel. It is also a structural feature in that it helps to retain the accent top panel on base panel. The structure further provides added height to the fence panel, railing panel, or a gate which may be needed in order to meet certain building codes or satisfy an added level of security.

Figure 13:
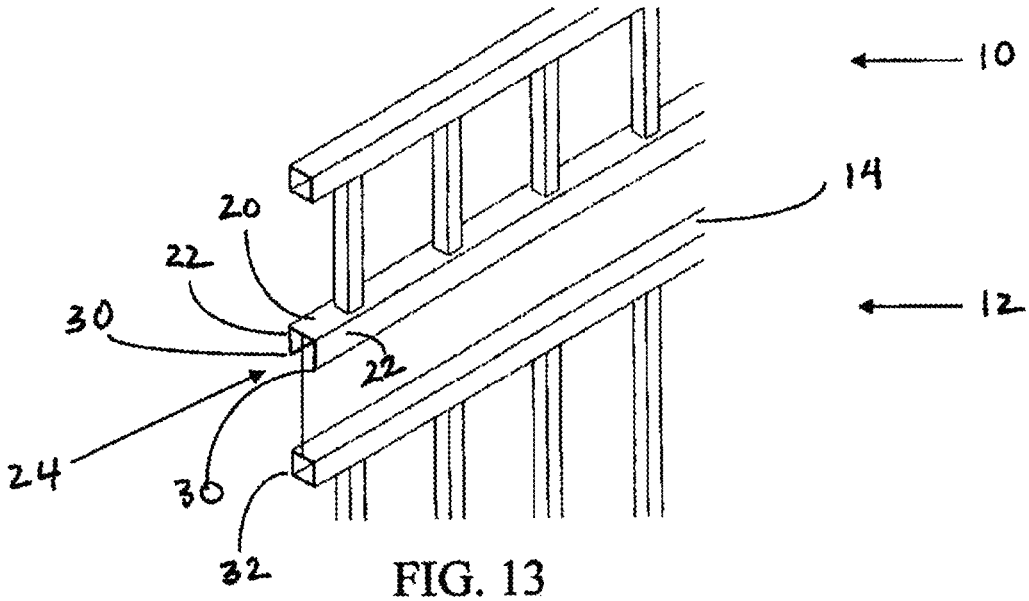
FIGS. 13-15 illustrate bead/detent clip or snap installation.
Figure 14:
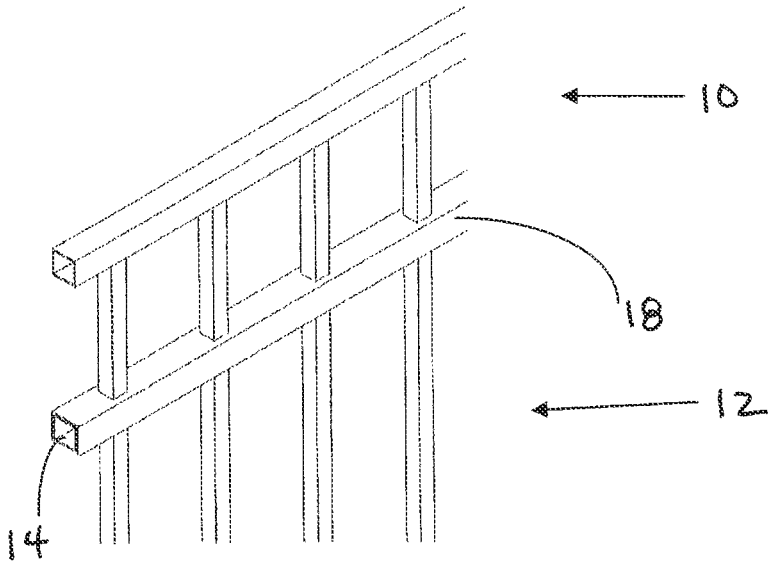
Figure 15:
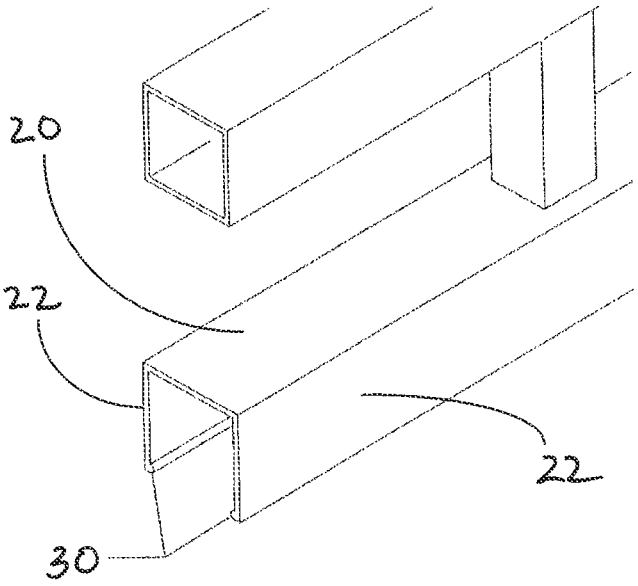

Reference is now made to FIGS. 13-15 wherein there is shown a third implementation for an accent top panel 10 including improved means for securing the accent top panel to a base panel 12. Again, the accent top panel includes a base rail having a flat web 20 and a pair of opposed side walls 22 which extend from the web to define a rail channel 24. The decorative accent features (architectural or ornamental motif features) of the top panel are mounted to and above the base rail. The base rail 18 is sized and shaped to fit over the top one of the elongate rails 14 such that the elongate rail is received by the rail channel. In particular, FIGS. 13-15 illustrate that the base rail is designed such that an inner surface of the opposed side walls includes an inwardly projecting bead (or detent) 30 which either engages a bottom edge of the opposed sides of the top elongate rail or snugly contacts the opposed sides of the top elongate rail in a press-fit manner. FIGS. 13-15 illustrate the former implementation where the inwardly projecting bead 30 is positioned at a bottom edge of each pair of opposed side walls. The bead is sized such that it will engage again the bottom edge 32. In this implementation, the dimensions and manufacturing tolerances with respect to the opposed side walls need not be so precise as to snugly contact the opposed sides of the top elongate rail since the inwardly extending bead will serve to secure the accent top panel. Preferably, the depth of the pair of opposed side walls is chosen such that the elongate top rail is received fully within the rail channel. In other words, from a horizontal point of view, after the accent top panel has been installed, one would not be able to see the sides of the elongate top rail. This is an aesthetic feature which preserves the illusion that the accent top panel and base panel are a single panel. It is also a structural feature in that it helps to retain the accent top panel on base panel. This is of some importance in this implementation since the bead is located at the bottom edge.

Figure 16A:
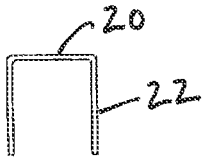
FIGS. 16A-16I illustrate components and installation options.
Figure 16D:
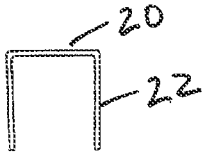
Figure 16G:
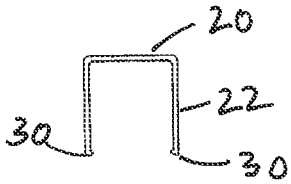
Figure 16B:
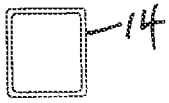
Figure 16E:
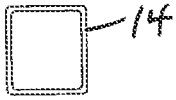
Figure 16H:
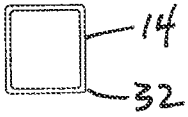
Figure 16C:
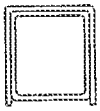
Figure 16F:
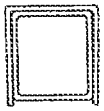
Figure 16I:
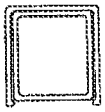

FIGS. 16A-16I schematically show the three implementations. In FIGS. 16A-16C, the close tolerance implementation is shown where a snug or press fit exists between the accent top panel and the base panel due to the careful selection of and control over dimensions and manufacturing tolerances. In FIGS. 16D-16F, the clamp implementation is shown where the opposed side walls are angled slightly inwardly to form a biasing clamp against the opposed sides of the top elongate rail. In FIGS. 16G-16I, the bead implementation is shown where the opposed side walls include an inwardly projecting bead at a bottom edge which engages a corresponding bottom edge of the top elongate rail.

In summary, the attachment of the accent top panel to the base panel (for example, fence panel, railing panel, or gate) is achieved by the depth of the sides of the rail channel being slightly longer than the depth of the sides of the top elongate rail, and by the use of close tolerances between the rail channel and the top elongate rail. The sides of the rail channel can be either straight or bent slightly inwards to create a close tolerance fit that prevents the accent top panel from being loose on the fence. This close tolerance also gives the connection between the accent top panel and the fence/railing/gate panel top elongate rail a snap type fit making the Top Accent tight and secure on the fence/railing/gate panel. Alternatively, the snap fit between the accent top panel and the elongate rail of the base panel is formed using a bead on the bottom edge of each side wall (leg) of the rail channel. These beads can run the full length of the rail channel legs or be small sections of bead spaced along the length of the rail channel. The beads snap over the bottom edge of the fence/railing/gate panel top elongate rail, securing the accent top panel to the base panel. If the leg is shorter than the depth of the elongate top rail, the bead can instead press against the side of the elongate rail.

It will be understood that fasteners, welding, brackets, or an adhesive may be used in addition to the securing means described above.

What is claimed is:

1. A barrier system, comprising:

a base barrier panel including a top elongate rail, said top elongate rail having a top surface and opposed first side walls extending perpendicularly from said top surface and presenting planar outer surfaces having a first depth; and an accent top panel configured for installation on the top elongate rail of said base barrier panel, the accent top panel including a U-shaped channel configured to be installed downwardly over the top elongate rail and defined by a web member having an upwardly facing top surface and a pair of opposed second side walls extending downwardly from said web member in a position wherein a planar inner surface of said second side walls is in surface contact with said planar outer surface of the first side walls and further having a decorative accent feature extending upwardly from and mounted by direct attachment to the upwardly facing top surface of the web member;

wherein each second side wall extends downwardly from the web member with a second depth at least equal to the first depth of said planar outer surfaces of the top elongate rail so that when the accent top panel is installed over the top elongate rail the planar outer surfaces of the top elongate rail are fully covered by the opposed second side walls of the U-shaped channel so as to present a visual appearance that the base barrier panel and accent top panel form a single barrier panel;

wherein the base barrier panel further includes a plurality of first upright members extending downwardly from the top elongate rail and wherein the decorative accent feature of the accent top panel comprises a plurality of second upright members extending upwardly from the upwardly facing top surface of the web member; and wherein the plurality of first upright members and the plurality of second upright members are vertically aligned with each other to present a visual appearance of a corresponding plurality of single upright members extending vertically through and perpendicular to both the top elongate rail and the web member of the U-shaped channel.

2. The barrier system of claim 1, wherein corresponding ones of the first and second upright members have a same cross-sectional size and shape.

3. The barrier system of claim 1, wherein said base barrier panel comprises one of a fence panel, a gate panel or a railing panel.

4. The barrier system of claim 1, wherein the U-shaped channel supports a press fit securing mechanism with respect to receiving and attaching to the top elongate rail.

5. The barrier system of claim 4, wherein the press fit securing mechanism comprises said top elongate rail being designed with dimensions and manufacturing tolerances such that the opposed second side walls snugly contact the opposed planar outer surfaces of the first side walls.

6. The barrier system of claim 1, wherein the U-shaped channel supports a clamp fit securing mechanism with respect to receiving and attaching to the top elongate rail.

7. The barrier system of claim 6, wherein the clamp fit securing mechanism comprises said opposed second side walls being angled slightly inwardly to form a biasing clamp against said opposed planar outer surfaces of the first side walls.

8. The barrier system of claim 1, wherein the U-shaped channel supports a snap fit securing mechanism with respect to receiving and attaching to the top elongate rail.

9. The barrier system of claim 8, wherein the snap fit securing mechanism comprises a bead structure extending along the U-shaped channel which engages a bottom edge of the top elongate rail of the base barrier panel.

10. The barrier system of claim 8, wherein the snap fit securing mechanism comprises a bead which inwardly projects from the planar inner surface of at least one of the opposed first side walls, the bead engaging an outer surface of the top elongate rail of the base barrier panel.

11. The barrier system of claim 1, wherein the decorative accent feature comprises one of an architectural motif or an ornamental motif.

12. The barrier system of claim 1, wherein the second depth is greater than the first depth.

13. The barrier system of claim 1, wherein the plurality of upright members are directly mounted to said top elongate rail.

14. A barrier system, comprising:

a base barrier panel including a top elongate rail, said top elongate rail having a top surface and opposed first side walls extending perpendicularly from said top surface and presenting planar outer surfaces; and an accent top panel including a U-shaped channel defined by a web member having an upwardly facing top surface and a pair of opposed second side walls extending downwardly from said web member in a position wherein a planar inner surface of said second side walls is in surface contact with said planar outer surface of the first side walls and further having a decorative accent feature extending upwardly from and mounted by direct attachment to the upwardly facing top surface of the web member;

wherein said opposed first side walls of the top elongate rail are configured for a downward installation of the U-shaped channel of the accent top panel over the top elongate rail of said base barrier panel such that the pair of opposed second side walls extending downwardly from said web member fully cover the planar outer surfaces of the top elongate rail so as to present a visual appearance that the base barrier panel and the accent top panel form a single barrier panel;

wherein the base barrier panel further includes a plurality of first upright members extending downwardly from the top elongate rail and wherein the decorative accent feature of the accent top panel comprises a plurality of second upright members extending upwardly from the upwardly facing top surface of the web member; and wherein the plurality of first upright members and the plurality of second upright members are vertically aligned with each other to present a visual appearance of a corresponding plurality of single upright members extending vertically through and perpendicular to both the top elongate rail and the web member of the U-shaped channel.

15. A barrier system, comprising:

a base barrier panel including a top elongate rail, said top elongate rail having a top surface and opposed first side walls extending perpendicularly from said top surface and presenting planar outer surfaces and further including a plurality of first upright members extending downwardly from the top elongate rail; and an accent top panel including a U-shaped channel defined by a web member having an upwardly facing top surface and a pair of opposed second side walls extending downwardly from said web member in a position wherein a planar inner surface of said second side walls is in surface contact with said planar outer surface of the first side walls and further having a plurality of second upright members extending upwardly from the upwardly facing top surface of the web member;

wherein said opposed first side walls of the top elongate rail are configured for a downward installation of the U-shaped channel of the accent top panel over the top elongate rail of said base barrier panel such that the pair of opposed second side walls extending downwardly from said web member fully cover the planar outer surfaces of the top elongate rail so as to present a visual appearance that the base barrier panel and the accent top panel form a single barrier panel; and wherein the plurality of first upright members and the plurality of second upright members are vertically aligned with each other to present a visual appearance of a corresponding plurality of single upright members member extending vertically through and perpendicular to both the top elongate rail and the web member of the U-shaped channel.

* * * * *